US010072674B2

(12) United States Patent
Völker et al.

(10) Patent No.: US 10,072,674 B2
(45) Date of Patent: Sep. 11, 2018

(54) SUCTION JET PUMP

(71) Applicant: CONTINENTAL AUTOMOTIVE GMBH, Hannover (DE)

(72) Inventors: Marc Völker, Magdeburg (DE); Andreas Sausner, Eschborn (DE)

(73) Assignee: Continental Automotive GmbH, Hannover (DE)

( * ) Notice: Subject to any disclaimer, the term of this patent is extended or adjusted under 35 U.S.C. 154(b) by 237 days.

(21) Appl. No.: 14/772,686

(22) PCT Filed: Mar. 5, 2014

(86) PCT No.: PCT/EP2014/054233

§ 371 (c)(1),
(2) Date: Sep. 3, 2015

(87) PCT Pub. No.: WO2014/135574

PCT Pub. Date: Sep. 12, 2014

(65) Prior Publication Data

US 2016/0017896 A1 Jan. 21, 2016

(30) Foreign Application Priority Data

Mar. 7, 2013 (DE) ..... 10 2013 203 942

(51) Int. Cl.
*F04F 5/00* (2006.01)
*F04F 5/46* (2006.01)
(Continued)

(52) U.S. Cl.
CPC ..... *F04F 5/464* (2013.01); *F04F 5/02* (2013.01); *F04F 5/10* (2013.01); *F04F 5/14* (2013.01); *F04F 5/24* (2013.01)

(58) Field of Classification Search
CPC ..... F04F 5/464; F04F 5/10; F04F 5/00; F04F 5/14; F04F 5/16; F04F 5/02; F04F 5/124; F04F 5/04; F04F 5/24
(Continued)

(56) References Cited

U.S. PATENT DOCUMENTS 1,782,310 A * 11/1930 Overstreet ..... F04F 5/461 417/172
2,114,905 A * 4/1938 McMahon ..... F04F 5/464 417/172
(Continued)

FOREIGN PATENT DOCUMENTS

CH 83 025 2/1920
CN 85200098 10/1985
(Continued)

OTHER PUBLICATIONS

Office Action dated Aug. 1, 2016 which issued in the corresponding Chinese Patent Application No. 201480011818.1.

*Primary Examiner* — Devon Kramer
*Assistant Examiner* — Christopher Bobish
(74) *Attorney, Agent, or Firm* — Cozen O'Connor

(57) ABSTRACT

A suction jet pump has a fuel line, a propulsion jet nozzle, an intake region, a mixing tube, and a diffuser. The propulsion jet nozzle and the mixing tube are oriented rectilinearly with respect to one another. As viewed in the direction of flow, the diffuser has a course which differs from the course of the mixing tube.

3 Claims, 2 Drawing Sheets

(51) Int. Cl.

| | |
|---|---|
| ***F04F 5/14*** | (2006.01) |
| ***F04F 5/02*** | (2006.01) |
| ***F04F 5/24*** | (2006.01) |
| ***F04F 5/10*** | (2006.01) |

(58) Field of Classification Search
USPC ..... 417/172, 198
See application file for complete search history.

(56) References Cited

U.S. PATENT DOCUMENTS

| | | | | | |
|---|---|---|---|---|---|
| 2,616,614 | A | | 11/1952 | Plummer, Jr. | |
| 3,064,878 | A | * | 11/1962 | Bayles | F04F 5/461 417/151 |
| 3,174,679 | A | * | 3/1965 | Stoker | F04F 5/464 417/163 |
| 3,274,065 | A | | 9/1966 | Kierulf et al. | |
| 3,464,189 | A | * | 9/1969 | Mergenthaler | B01D 47/10 261/124 |
| 5,055,003 | A | | 10/1991 | Svensson | |
| 5,993,167 | A | * | 11/1999 | Mochizuki | F04F 5/461 417/151 |
| 6,086,334 | A | * | 7/2000 | Castel | F04D 11/00 417/171 |
| 8,197,602 | B2 | * | 6/2012 | Baron | B08B 3/12 134/1 |

FOREIGN PATENT DOCUMENTS

| | | | | |
|---|---|---|---|---|
| DE | 390 448 | | 2/1924 | |
| DE | 14 64 693 | | 5/1970 | |
| DE | 36 14 872 | | 11/1986 | |
| DE | 88 15 751 | | 2/1989 | |
| DE | 39 41 892 | | 6/1990 | |
| DE | 195 00 346 | | 7/1996 | |
| DE | 195 30 423 | | 2/1997 | |
| DE | 199 57 066 | | 5/2001 | |
| DE | 102 29 801 | | 1/2004 | |
| EP | 1 004 777 | | 5/2000 | |
| GB | 1025345 | A * | 4/1966 | F04F 5/464 |
| GB | 2378223 | | 2/2003 | |
| JP | 63-176700 | | 7/1988 | |
| SU | 737707 | | 6/1980 | |
| WO | WO 01/23765 | | 4/2001 | |

* cited by examiner

SUCTION JET PUMP

CROSS REFERENCE TO RELATED APPLICATIONS

This is a U.S. national stage of application Ser. No. PCT/EP2014/054233, filed on Mar. 5, 2014. Priority is claimed on German Application No. DE102013203942.5, filed Mar. 7, 2013; the content of which is incorporated herein by reference.

BACKGROUND OF THE INVENTION

1. Field of the Invention

The invention relates to a suction jet pump having a propellant line, a propulsion jet nozzle, a suction region, a mixing pipe, and a diffuser, wherein the propulsion jet nozzle and the mixing pipe are orientated in a linear manner with respect to each other.

2. Detailed Description of Prior Art

Suction jet pumps are known and are used to convey fluids and gases, wherein the main advantage thereof is that they do not require any electromotive drive, but are instead driven by a propellant supplied by a propellant line. For this reason, they are used in motor vehicles to convey fuel in the fuel container in that they are used to redistribute the fuel in the fuel container or to fill surge tanks of conveyor units. The suction jet pumps are in this instance generally driven by a fuel pump by a portion of the conveying quantity of the fuel pump being branched off and being used to drive the suction jet pump. The disadvantage of suction jet pumps is their relatively low degree of efficiency. For this reason, the sizing of the individual components of the suction jet pump has particular significance in order to achieve the greatest possible conveying power. In particular the length of the individual components is decisive in this instance. With an in-line arrangement of the suction jet pump, however, lengths are thereby very quickly reached at which suction jet pumps can no longer be assembled in fuel containers.

It is known to shorten the length of the suction jet pump by angling the propellant line directly upstream of the propulsion jet nozzle through 180° so that the propellant line extends parallel with the remaining suction jet pump having a propulsion jet nozzle, suction region, mixing pipe and diffuser. Yet another shortening of the length of the suction jet pump can be achieved by the cross section of the nozzle being increased. With the propulsion quantity thereby increased and consequently associated increase of the drive power, shortened lengths of the components of the suction jet pump can be compensated for. Since the drive quantity branched off from the fuel pump for the suction jet pump is substantially proportional to the total delivery quantity of the fuel pump, the use of fuel pumps controlled in accordance with requirements has the disadvantage that, in travel situations with low fuel consumption, the propulsion quantity branched off for the suction jet pump approaches zero, which has a negative effect on the degree of efficiency of the suction jet pump. In this regard, with fuel pumps controlled in accordance with requirements, the shortened lengths of the components of the suction jet pump cannot be compensated for by an increased propulsion quantity.

SUMMARY OF THE INVENTION

An object of one embodiment of the invention is to provide a suction jet pump with a high degree of efficiency, which can also be used during driving by a fuel pump controlled in accordance with requirements with limited structural space.

The object is achieved in that, when viewed in the flow direction, the diffuser has a path that deviates from the path of the mixing pipe.

The suction jet pump according to one embodiment of the invention has a propulsion jet nozzle and a mixing pipe orientated in a linear manner with respect to each other. The diffuser, which is arranged downstream of the mixing pipe in the flow direction, has in contrast a path that deviates from the linear path of the mixing pipe. As a result of the path thereof, which deviates from the mixing pipe, the overall length of the suction jet pump is reduced so that the suction jet pump can also be used with limited structural space. With the deviating path of the diffuser, the orientation thereof, but not the length thereof, is changed. Consequently, on the one hand, the diffuser may maintain the required length thereof. With the required length thereof being maintained, the pressure increase, which is important for the degree of efficiency is produced in the diffuser to make the pressure difference with respect to the ambient pressure as low as possible. On the other hand, the mixing pipe can also maintain the required length thereof, which is particularly important for the degree of efficiency, without the use of the suction jet pump in limited structural space being impaired. Furthermore, this adaptation of the suction jet pump to a limited structural space enables driving via a fuel pump controlled in accordance with requirements since, as a result of the unnecessary length reduction of individual components of the suction jet pump, no increase of the nozzle cross section is required, which in particular in driving situations with low fuel consumption would have a negative effect on the degree of efficiency of the suction jet pump.

A small influence of the flow is achieved with a diffuser that has a curved path. With a curved diffuser, the suction jet pump can be adapted to the structural space available in an optimal manner since the curvature of the diffuser can be produced in all directions. The impairment of the degree of efficiency is in this instance kept within tight limits. Often, small curvatures are already sufficient to be able to make better use of the structural space available. The curvature can extend in accordance with the conditions for use over the entire length of the diffuser or only over a portion of the length.

A particularly small influence of the degree of efficiency is achieved with a suction jet pump in which a redirection element is arranged between the mixing pipe and the diffuser. This embodiment has the disadvantage that the mixing pipe has the optimal length thereof for the degree of efficiency. The adaptation of the suction jet pump to the structural space that is available is consequently carried out substantially via the redirection element.

Depending on the radius of curvature and the structural space available, the redirection may be carried out from a few degrees, more than 90°, and beyond.

A particularly small overall length of the suction jet pump is achieved with a redirection element whose redirection is 180° so that the two ends of the redirection element are orientated parallel with each other. In addition, such a suction jet pump requires a substantially shorter propellant line than a suction jet pump in which the 180° redirection is carried out upstream of the propellant nozzle.

A suction jet pump in which the redirection element is constructed for connection to the mixing pipe and the diffuser has a particularly low level of production complexity. This embodiment enables the use of the same mixing pipe and the same diffuser for different application locations. The adaptation of the suction jet pump to the respective installation conditions is carried out exclusively via the configuration of the redirection element.

The assembly of the suction jet pump is significantly simplified when the redirection element is constructed to be integral with the mixing pipe or the diffuser or with both components. In a simple embodiment, all the components are produced from plastics material by injection-molding.

In an advantageous embodiment, the diffuser has a linear path downstream of the redirection element. The pressure increase of the flow in the diffuser can thereby be carried out in an appropriate manner as a result of the linear path thereof, which has a positive effect on the degree of efficiency.

In another embodiment, the diffuser has a curved path downstream of the redirection element. This affords the possibility of further adaptation of the suction jet pump to the structural space which is available.

A particularly small structural length and a small spatial requirement are achieved according to another advantageous embodiment with a suction jet pump whose diffuser surrounds the mixing pipe in a coaxial manner. In this embodiment, the flow is discharged from the mixing pipe and is redirected by the diffuser through 180° to then flow through the diffuser in the opposite direction and consequently in a path that deviates from the mixing pipe.

With the coaxial arrangement of the mixing pipe and diffuser, the flow in the diffuser is not impaired when the diffuser is secured by the outer periphery thereof and is positioned with respect to the mixing pipe. Such a securing is produced when the diffuser is secured to another component and not to other portions of the suction jet pump.

A simpler production with only little influence of the flow in the diffuser is produced when the diffuser is connected to the propulsion jet nozzle and is positioned in this manner with respect to the mixing pipe. Such a connection may be individual webs which are either formed on the diffuser or in the region of the propulsion jet nozzle and that engage with the other portion or are welded thereto, respectively.

The diffuser may have an opening angle of between 1° and 10°.

BRIEF DESCRIPTION OF THE DRAWINGS

The invention is explained in greater detail with reference to a plurality of embodiments, in which.

DETAILED DESCRIPTION OF THE PRESENTLY PREFERRED EMBODIMENTS

Figure 1:
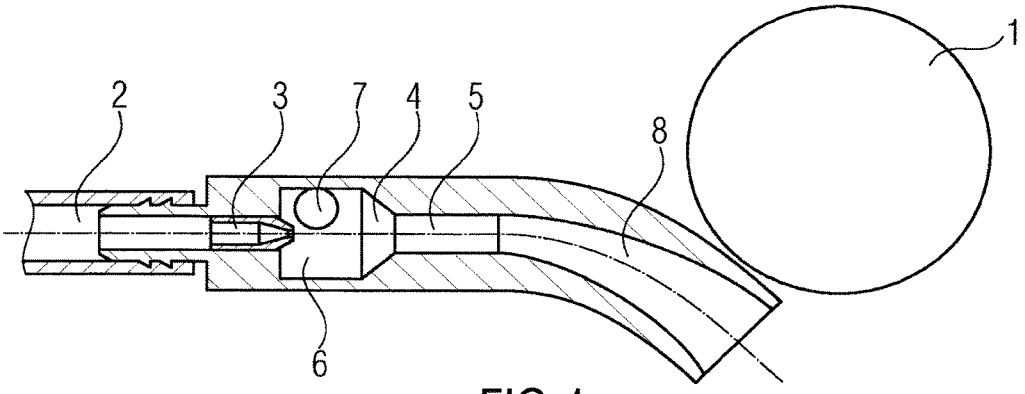
FIG. 1 is a suction jet pump according to the invention.

FIG. 1 shows a suction jet pump and a filter 1 in a fuel container of a motor vehicle. The suction jet pump comprises a propellant line 2, via which fuel is supplied from a fuel pump, which is not illustrated, as a propellant of the suction jet pump. The propellant line 2 is adjoined by a propellant nozzle 3. The fuel discharged from the propellant nozzle 3 is introduced via the collection funnel 4 into the mixing pipe 5. As a result of the high speed of the fuel which is discharged, there is produced in a suction region 6 a reduced pressure by which fuel is drawn via a suction opening 7 from the fuel container into the mixing pipe 5. After the mixing pipe 5 has been passed, the conveyed fuel reaches the diffuser 8. The diffuser 8 is constructed to be curved and consequently has a path which deviates from the linear path of the mixing pipe 5. As a result of the curvature of the diffuser 8, the suction jet pump, in spite of the arrangement of the filter 1, can be positioned at the illustrated position in the fuel container.

Figure 2:
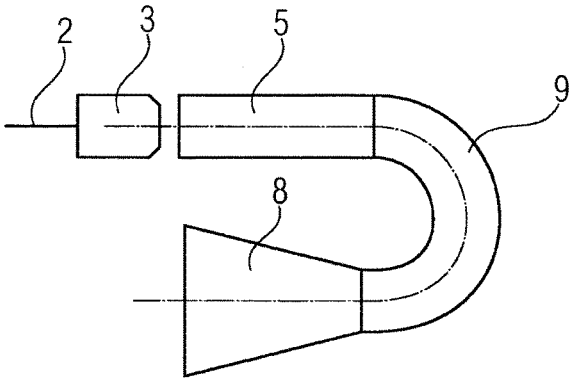
FIGS. 2, 3 are suction jet pumps having a redirection element.

FIG. 2 shows a suction jet pump having a redirection element 9, arranged between the mixing pipe 5 and the diffuser 8. The redirection element 9 redirects the conveyed fuel through 180° so that the diffuser 8 has a path, which is directed parallel with and counter to the path of the mixing pipe 5. Since the redirection is carried out via the redirection element 9 and this is a separate component, the diffuser 8 may be constructed in a linear manner. The assembly of the mixing pipe 5, redirection element 9 and diffuser 8 is carried out by a plug-type connection or by adhesive bonding or welding.

Figure 3:
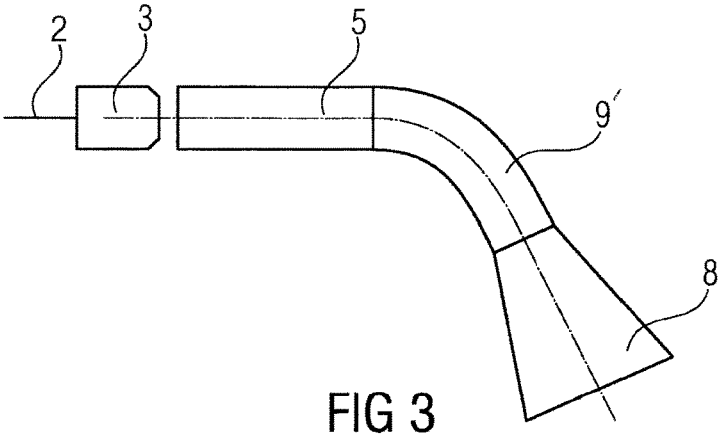

FIG. 3 shows a suction jet pump having a redirection element 9'. In contrast to FIG. 2, the redirection element 9' has a curvature of only 45°. It is further connected to the diffuser 8 in an integral manner so that there is only one assembly location with respect to the mixing pipe 5.

Figure 4:
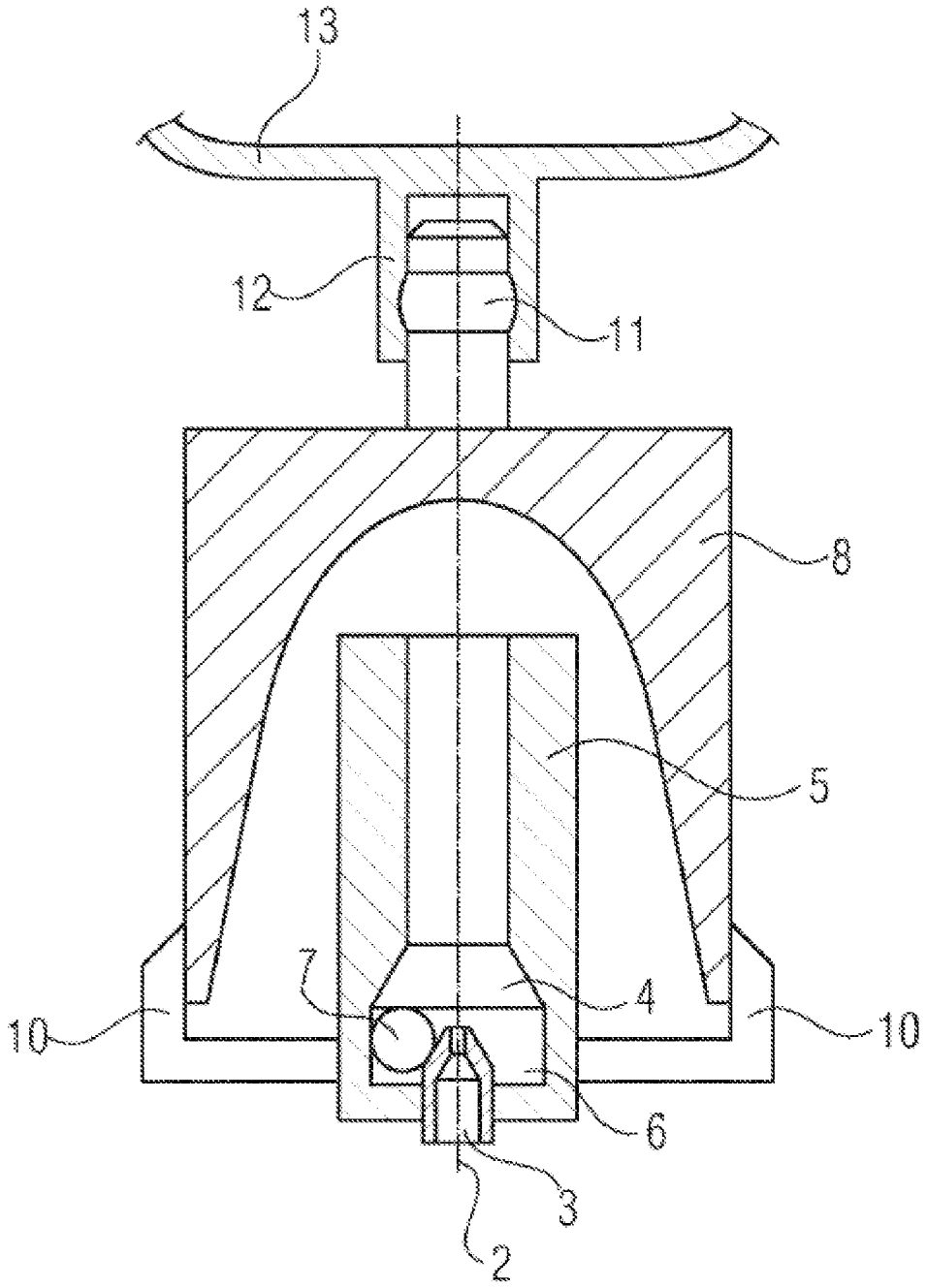
FIG. 4 shows a suction jet pump having a coaxial diffuser.

The suction jet pump in FIG. 4 has a diffuser 8 arranged coaxially with respect to the mixing pipe 5 and surrounds mixing pipe 5. The conveyed fuel is discharged from the mixing pipe 5 and is redirected by the diffuser through 180° to then flow through the diffuser 8 in an opposing direction and consequently in a path that deviates with respect to the mixing pipe 5. The securing of the diffuser 8 is carried out by individual webs 10 that extend from the outer periphery of the diffuser 8 into the region of the propulsion jet nozzle 3. At the end face of the diffuser 8 facing away from the mixing pipe 5, there is integrally formed an engaging step 11 that engages in a corresponding engaging location 12 of another component 13. Via this connection, the diffuser 8 is also retained and positioned with respect to the mixing pipe 5. However, it is also conceivable for the diffuser 8 to be secured by only one of the two connection types.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A suction jet pump comprising:

a propellant line;

a propulsion jet nozzle fluidically downstream of the propellant line;

a suction region;

a mixing pipe arranged fluidically downstream of the suction region and orientated in a linear manner with respect to the propulsion jet nozzle;

a diffuser having an uninterrupted concave surface facing an outlet of the mixing pipe and arranged to surround the mixing pipe in a coaxial manner, wherein the diffuser, when viewed in a flow direction, has a path that deviates from a path of the mixing pipe; and a plurality of individual webs configured to support the diffuser that extend from an outer periphery of the diffuser into a region of the propulsion jet nozzle.

2. The suction jet pump as claimed in claim 1, wherein the diffuser has a curved path.

3. The suction jet pump as claimed in claim 1, wherein the diffuser is substantially funnel shaped and an output of the diffuser is arranged along an axis of the diffuser.

* * * * *